US007905560B2

(12) United States Patent
Vardaro et al.

(10) Patent No.: US 7,905,560 B2
(45) Date of Patent: Mar. 15, 2011

(54) SECURITY SHOWCASE

(76) Inventors: Antonio Vardaro, Montreal (CA); Enzo Vardaro, Montreal (CA)

( * ) Notice: Subject to any disclaimer, the term of this patent is extended or adjusted under 35 U.S.C. 154(b) by 408 days.

(21) Appl. No.: 11/775,608

(22) Filed: Jul. 10, 2007

(65) Prior Publication Data

US 2008/0079337 A1 Apr. 3, 2008

Related U.S. Application Data

(60) Provisional application No. 60/806,796, filed on Jul. 10, 2006.

(51) Int. Cl.
*A47B 88/00* (2006.01)

(52) U.S. Cl. ..... 312/310; 312/137; 312/139.1; 312/272.5

(58) Field of Classification Search ..... 312/21–25, 312/27–29, 114, 137, 138.1, 139, 139.1, 312/306, 310, 312, 126–130, 271–272, 272.5, 312/275–276

See application file for complete search history.

(56) References Cited

U.S. PATENT DOCUMENTS

| | | | | |
|---|---|---|---|---|
| 1,018,679 | A * | 2/1912 | Omwake | 312/139 |
| 1,078,795 | A * | 11/1913 | Meinel | 312/139.1 |
| 1,161,900 | A * | 11/1915 | Smith | 312/139.1 |
| 2,284,531 | A | 5/1942 | Miller | |
| 4,141,610 | A | 2/1979 | Ando | |
| 4,381,876 | A | 5/1983 | Fenwick | |
| 4,500,148 | A | 2/1985 | King | |
| 4,560,214 | A | 12/1985 | Otema | |
| 4,660,902 | A | 4/1987 | Resendez, Jr. | |
| 4,929,862 | A | 5/1990 | Hamilton et al. | |
| 4,942,328 | A * | 7/1990 | Price | 312/306 |
| 5,165,768 | A | 11/1992 | Zarrabi et al. | |
| 5,415,010 | A * | 5/1995 | Woo | 62/258 |
| 5,483,905 | A | 1/1996 | Johansson | |
| 5,503,471 | A | 4/1996 | Aspenwall | |
| 5,524,977 | A | 6/1996 | Orawski | |
| 5,622,121 | A | 4/1997 | Holler | |
| 5,655,462 | A | 8/1997 | Holler | |
| 5,664,854 | A | 9/1997 | Letch | |
| 5,665,304 | A | 9/1997 | Heinen et al. | |
| 5,733,021 | A | 3/1998 | O'Neill et al. | |
| 5,791,749 | A | 8/1998 | O'Neill et al. | |
| 5,820,233 | A | 10/1998 | Hahn | |
| 5,853,235 | A | 12/1998 | Barnes | |
| 5,990,938 | A | 11/1999 | Bern | |

(Continued)

FOREIGN PATENT DOCUMENTS

DE 4228715 3/1994

(Continued)

*Primary Examiner* — Hanh V Tran
(74) *Attorney, Agent, or Firm* — Ladas & Parry LLP

(57) ABSTRACT

A security showcase having a housing with storage and display portions for respectively storing and displaying items. The display portion includes a support for supporting items and being positionable between an item-storing position, within the storage portion, and an item-displaying position for displaying items. A closure with closure elements is movably mounted to the housing. The closure elements are movable between a closed position, for enclosing the support within the storage portion and an open position for when the support is in the item-displaying position. The closure may be automated and move in accordance with the position of the support or operationally linked thereto for simultaneous movement thereof. The closure may be positioned within the storage portion when the support is in the item-displaying position.

39 Claims, 14 Drawing Sheets

U.S. PATENT DOCUMENTS

| | | | | |
|---|---|---|---|---|
| 6,322,180 | B1 | 11/2001 | Hall et al. | |
| 6,375,286 | B1 | 4/2002 | Miller et al. | |
| 6,540,311 | B2 | 4/2003 | Canedy et al. | |
| 6,547,845 | B2 | 4/2003 | Grant, Sr. | |
| 6,764,145 | B2 | 7/2004 | Canedy et al. | |
| 6,769,752 | B2 | 8/2004 | Hahn et al. | |
| 6,802,576 | B2 * | 10/2004 | Shepherd | 312/117 |
| 6,832,822 | B2 | 12/2004 | Canedy et al. | |
| 6,851,770 | B2 | 2/2005 | Canedy et al. | |
| 7,584,705 | B2 * | 9/2009 | Chen | 108/50.01 |
| 2007/0194674 | A1 * | 8/2007 | Salter | 312/312 |

FOREIGN PATENT DOCUMENTS

| | | | | |
|---|---|---|---|---|
| DE | 10200807 | | 7/2003 | |
| GB | 2278995 | * | 12/1994 | 312/114 |
| JP | 52007700 | * | 1/1977 | 312/306 |

* cited by examiner

SECURITY SHOWCASE

CROSS-REFERENCE TO RELATED APPLICATIONS

The present application is based on U.S. Provisional Application No. 60/806,796 filed on Jul. 10, 2006 which is incorporated herein by reference in its entirety.

FIELD OF THE INVENTION

The present invention relates to a showcase. More specifically, but not exclusively, the present invention relates to a security showcase for displaying and protecting items including valuable goods such as jewelry and the like.

BACKGROUND OF THE INVENTION

Display cases, also known as showcases, are widely used for displaying high-value articles such as jewelry, coins, electronics, cameras, etc. It is readily understood that the typical display case having one or more glass windows is particularly susceptible to theft wherein the criminal smashes the glass and removes as many valuable articles as possible before escaping. Due to the frequency of such "smash and grab" crimes, most retailers choose to remove high-value goods from their display cases at the close of business daily and relocate the merchandise into more secure storage. Unfortunately, the routine transfer of merchandise between the display case and storage causes many problems of its own, not the least of which is the increased labor required to perform the work.

Other problems include increased wear and tear on the merchandise and display fixtures, and increase problems with inventory and loss control.

Conventional display showcases having a theft preventing mechanism use a heavy steel sheet that needs to be manually positioned on top of the showcase to separate the glass portion of the showcase and the valuable goods. This operation is tedious, requires significant strength and may cause back injuries. The protective steel sheet, when moving between the stored position and the goods-protecting position, extends outside the perimeter of the display showcase. More floor space than the actual size of the showcase is required. This prevents the display showcase to be easily activated in a tight space.

Improvements in such showcases included providing a showcase with a housing that includes an lower storage section having an exterior obscuring wall and a fully enclosable display section mounted above the lower section. A platform is mounted within the lower storage section in order to be selectively raised into the display section for displaying items disposed thereon. A closure was provided to be selectively interposed between the display and storage sections. Such closures include conventional heavy panels which are inconvenient as explained above.

OBJECTS OF THE INVENTION

An object of the present invention is to provide a security showcase.

An object of the present invention is to provide a storage enclosure for a security showcase.

SUMMARY OF THE INVENTION

Aspects of the invention will now be disclosed hereunder.

In accordance with an aspect of the present invention, there is provided a security showcase comprising a housing comprising adjacent storage and display portions for respectively storing and displaying items therein; a support mounted to the housing for supporting items and being positionable between an item-storing position, wherein the support is positioned within the storage portion, and an item-displaying position, wherein items supported by the support are displayed via the display portion; and a closure comprising at least a pair of closure elements moveably mounted to the housing and being movable between a closed position, wherein the closure elements are interposed between the storage and display portions and mutually mated thereby enclosing the support within the storage portion when in the item-storing position, an open position when the support is in the item-displaying position.

In accordance with another aspect of the present invention, there is provided a security showcase comprising: a housing comprising adjacent storage and display portions for respectively storing and displaying items therein; a support movably mounted to the housing for supporting items and being moveable between an item-storing position, wherein the support is positioned within the storage portion, and an item-displaying position, wherein items supported by the support are displayed via the display portion; and a closure moveably mounted to the housing and being operationally linked to the support, wherein movement of the support to the item-storing position causes the closure to move to a closed position being interposed between the storage and display portions thereby enclosing the support within the storage portion and wherein movement of the support to the item-displaying position causes the closure to move towards an open position.

In accordance with a further aspect of the present invention, there is provided a security showcase comprising: a housing comprising adjacent storage and display portions for respectively storing and displaying items therein; a support mounted to the housing for supporting items and being positionable between an item-storing position, wherein the support is positioned within the storage portion, and an item-displaying position, wherein items supported by the support are displayed via the display portion; and an automated closure moveably mounted to the housing and moveable between a closed and an open position, wherein the automated closure is configured to move to a closed position being interposed between the storage and display portions when the support is in the item-storing position thereby enclosing the support within the storage portion and wherein the automated closure is configured to move to an open position when the support is in the item-displaying position.

In accordance with yet another aspect of the present invention, there is provided a security showcase comprising: a housing comprising adjacent storage and display portions for respectively storing and displaying items therein; a support mounted to housing for supporting items and being positionable between an item-storing position, wherein the support is positioned within the storage portion, and an item-displaying position, wherein items supported by the support are displayed via the display portion; and a closure moveably mounted to the housing and being movable between a closed position, wherein the closure is interposed between the storage and display portions thereby enclosing the support within the storage portion when in the item-storing position, and an open position, wherein the closure is positioned within the storage portion when the support is in the item-displaying position.

In accordance with yet a further aspect of the present invention, there is provided a security showcase comprising: a storage portion for storing items therein and comprising an opening thereof; a display portion for housing items to be displayed therein and being moveably mounted to the storage portion so as to be movable between an item-storing position, wherein the display portion is positioned within the storage portion, and an item-displaying position, wherein the display portion is positioned outwardly of the opening thereby displaying items; and a closure for selectively closing the opening thereby enclosing the display portion within the storage portion when in the item-storing position.

In accordance with still another aspect of the present invention, there is provided a storage enclosure for a security showcase comprising a display portion thereof, the storage enclosure being configured to be adjacently positioned to the display portion and comprising: a main body for storing items therein and having an opening thereof for communicating with the display portion; a support mounted within the main body for supporting items and being positionable between an item-storing position within the main body and an item-displaying position, wherein items supported by the support are to be displayed via the display portion; and a pair of closure elements moveably mounted to the main body and being movable between a closed position wherein the closure elements are mutually mated thereby closing the opening and enclosing the support within the main body, and an open position when the support is in the item-displaying position.

In accordance with still a further aspect of the present invention, there is provided a storage enclosure for a security showcase comprising a display portion thereof, the storage enclosure being configured to be adjacently positioned to the display portion and comprising: a main body for storing items therein and having an opening thereof for communicating with the display portion; a support movably mounted within the main body for supporting items and being moveable between an item-storing position within the main body and an item-displaying position, wherein items supported by the support are to be displayed via the display portion; and a closure moveably mounted to the main body and being operationally linked to the support, wherein movement of the support to the item-storing position causes the closure to move to a closed position closing the opening thereby enclosing the support within the main body, and wherein movement of the support to the item-displaying position causes the closure to move towards an open position.

In accordance with still yet another aspect of the present invention, there is provided a storage enclosure for a security showcase comprising a display portion thereof, the storage enclosure being configured to be adjacently positioned to the display portion and comprising: a main body for storing items therein and having an opening thereof for communicating with the display portion; a support mounted within the main body for supporting items and being positionable between an item-storing position within the main body and an item-displaying position, wherein items supported by the support are to be displayed via the display portion; and an automated closure moveably mounted to the main body and moveable between a closed and an open position; wherein the automated closure is configured to move to a closed position closing the opening when the support is in the item-storing position thereby enclosing the support within the main body, and wherein the automated closure is configured to move to an open position when the support is in the item-displaying position.

In accordance with still yet a further aspect of the present invention there is provided a storage enclosure for a security showcase comprising a display portion thereof, the storage enclosure being configured to be adjacently positioned to the display portion and, comprising: a main body for storing items therein and having an opening thereof for communicating with the display portion; a support mounted within the main body for supporting items and being positionable between an item-storing position within the main body and an item-displaying position, wherein items supported by the support are to be displayed via the display portion; and a closure moveably mounted to the main body and being movable between a closed position, wherein the closure closes the opening thereby enclosing the support within the main body when in the item-storing position, and an open position, wherein the closure is positioned within the storage enclosure when the support is in the item-displaying position.

Other objects, advantages and features of the present invention will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where.

The drawings appended hereto form part of the disclosure.

DETAILED DESCRIPTION OF ILLUSTRATIVE EMBODIMENTS

With reference to the appended drawings, illustrative embodiments of the present invention will be described herein so as to exemplify the invention and in no way limit the scope thereof.

Generally and non-exclusively stated, the present invention provides a security showcase having adjacent display and storage portions. The display portion providing for displaying items, the storage portion providing for securely hiding these items. The showcase also includes a movable support such as a platform movable between the display and storage portions for displaying or storing the items respectively. A closure is selectively interposed between the display and storage portions so as to securely enclose the support and items within the storage portion. In one aspect of the invention, the closure provides a pair of mutually mating closure elements. In another aspect of the invention, the closure is operationally linked to the support so as to open and close in accordance with the movement of the support between the display and support portions. In another aspect of the invention, the closure is automated. In another aspect of the invention, when the closure is opened it is positioned within the storage portion. Storage enclosures including a movable support and closure for such showcases are also provided. Also provided is a showcase with a storage portion and movable display portion so as to be moved within the storage portion when storing the items and as to be moved towards an opening of the storage portion when displaying the items.

With reference to FIGS. 1 to 7, a security showcase 10 in accordance with an illustrative embodiment of the present invention will now be described.

Figure 1:
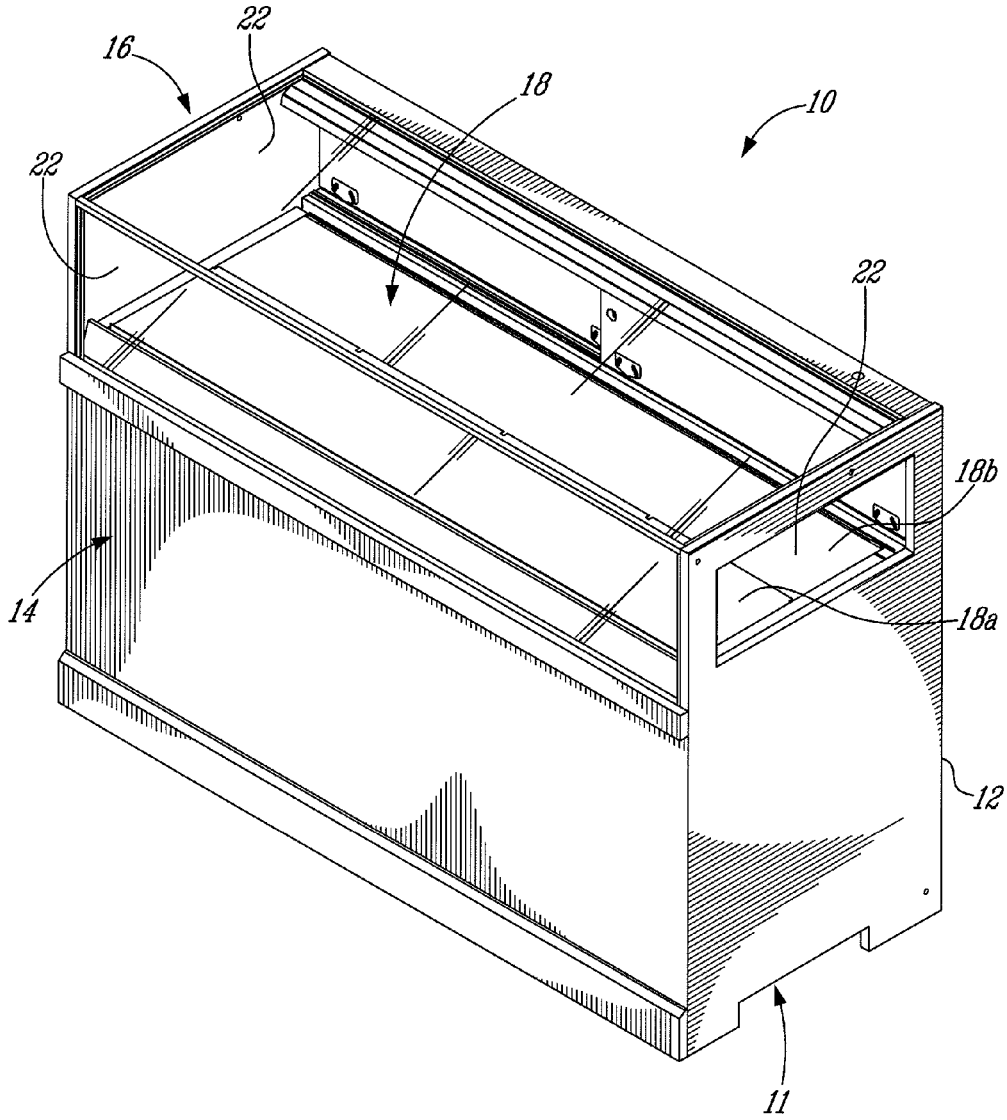
FIG. 1 is a perspective view of a security showcase in an item-storing position in accordance with an illustrative embodiment of the present invention.
Figure 2:
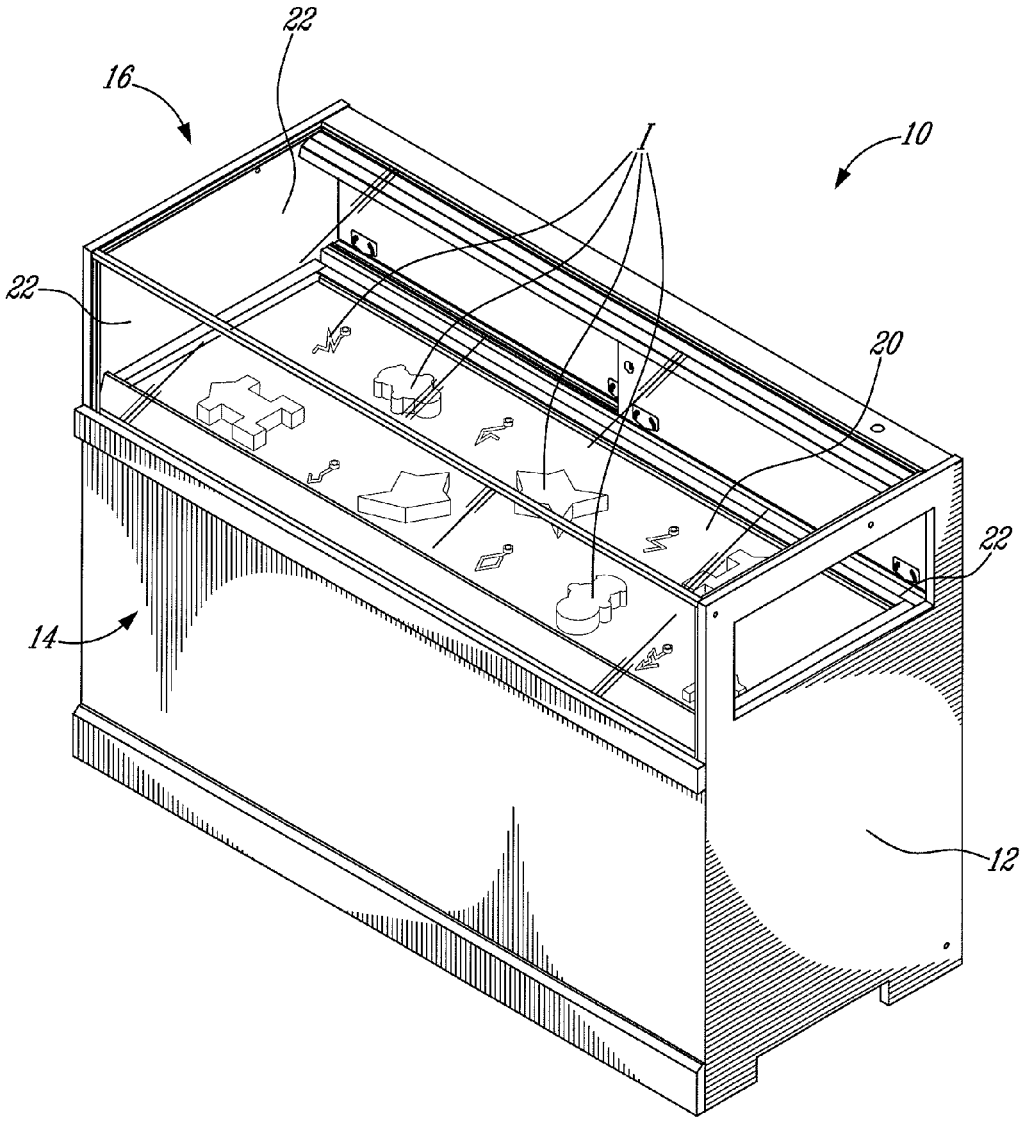
FIG. 2 is a perspective view of the security showcase of FIG. 1 in an item-displaying position.

FIGS. 1 and 2 show the security showcase 10 in the item-storing and item-displaying positions respectively. The security showcase 10 includes a housing 12 having adjacent storage and display portions 14 and 16, respectively. Security showcase 10 is a generally horizontal showcase with the display portion 16 being positioned on top of the storage portion 14. A closure 18 is movably mounted to the housing 12 and interposed between the storage and display portions 14 and 16 when in the closed position (FIG. 1). The closure 18 may also be selectively moved to an open position (FIG. 2) thereby exposing the support 20 movably mounted to the housing 12 for displaying items or goods I via the display portion 16. In a non-illustrated embodiment, wheels can be added to the underside 11 of the housing 12.

The display portion 16 includes transparent sections 22 made of glass or other rigid see-through material allowing customers in a store to view the items I therethrough. In contrast, the storage portion 14 is obscured in order to hide the items I stored away therein.

In this non-limiting example, the closure 18 includes a pair of oppositely disposed closure elements 18A and 18B in the form of protective covers or doors. The closed position in FIG. 1 refers to the position where the protective covers 18A and 18B are mutually mated hence, touching each other in order to prevent any access inside the storage portion 14 thereby hiding and protecting the valuable items or goods. Conversely, the open position in FIG. 2 refers to the position where the protective covers 18A and 18B are moved away from one another exposing the inside of the storage portion 14 and providing communication between the adjacent storage and display portions 14 and 16 respectively. Of course, in other configurations that may be contemplated within the scope of the present invention, the closure 18 includes a plurality of closure elements or a may comprise a single element and as such the open position refers to the position where the support 20 is exposed via the display portion 16 and the closed position refers to the position where the support 20 is obscured by the closure 18.

The support 20 is in the form of a generally horizontal movable platform for disposing items I thereon.

The item-storing position in FIG. 1 refers to the position where the support 20 is stored away within the storage section 14 and obscured by the closure 18 so as not to be visible through the display portion 16. Conversely, the item-displaying position in FIG. 2 refers to then the support 20 is not obscured by the closure 18 and the items it supports are now visible via the display portion 16. In fact, it can also be contemplated that the support 20 is barely movable or is fixed and as such positionable to the item-storing position refers to the position when the closure 18 is closed obscuring the support 20 through the display portion 16 and positionable tot the item-displaying position refers to the position when the closure 18 is opened and hence, exposed the support 20 via the display portion 16. As such, in the item-displaying position, the support 20 may be exposed yet within the storage portion 14 and hence, visible along with its items I via the display portion 16; the support 20 may be interposed between the storage and display portions 14 and 16 respectively and hence, visible via the display portion 16; the support 20 may also be positioned within the display portion 16 and hence, again visible via the display portion.

Figure 3:
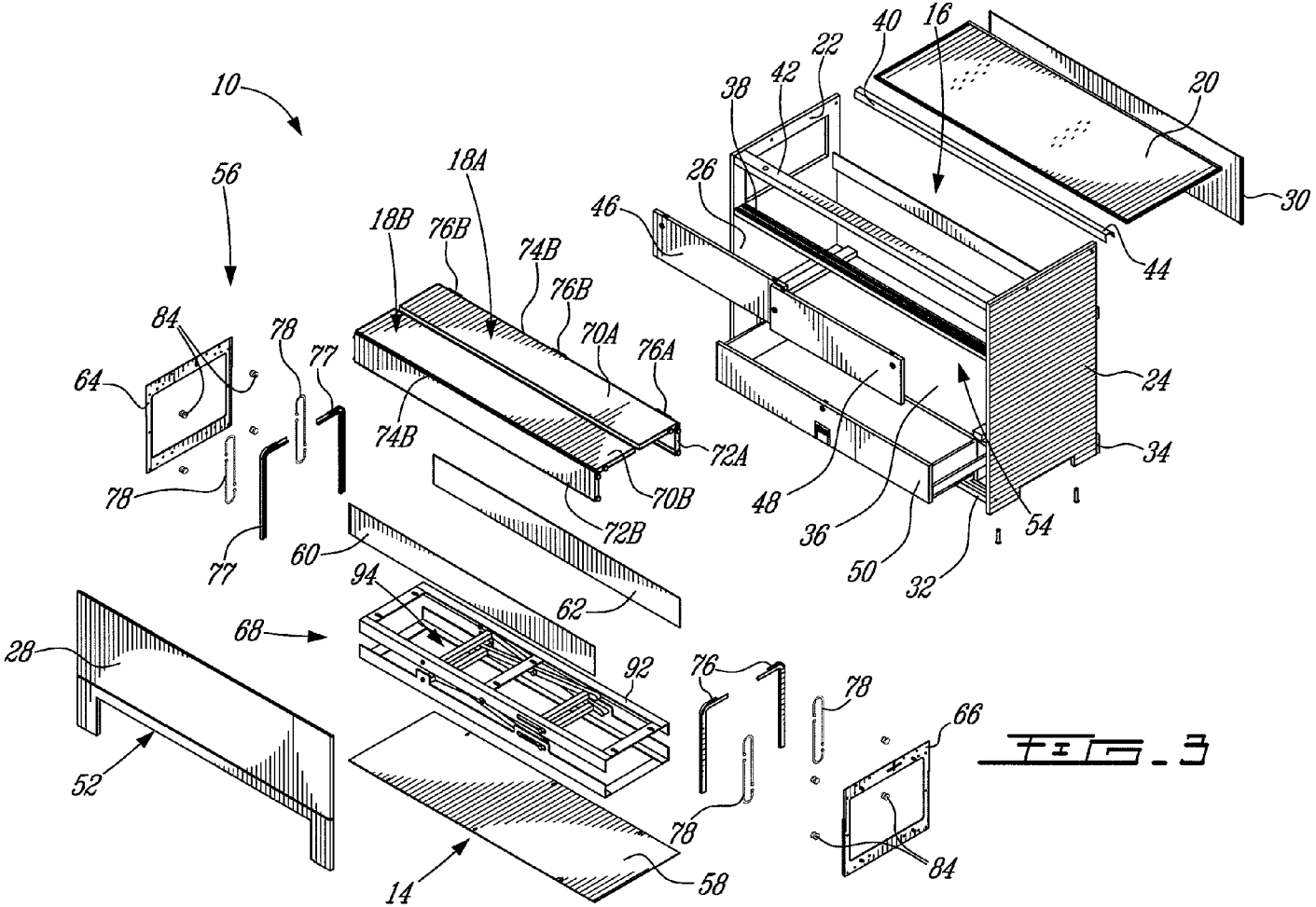
FIG. 3 is an exploded perspective view of the security showcase of FIG. 1.

Turning now to FIG. 3, the housing 12 includes opposite lateral panels 24 and 26, with panel 26 including a see-through portion 22, as well as front and rear panels 28 and 30 respectively. Panels 24 and 26 are interconnected via front and rear bottom longitudinal members 32 and 34 respectively, a floor panel 36, front and rear median longitudinal members 38 and 40 respectively, and front and rear top longitudinal members 42 and 44, respectively.

A pair of sliding lock doors 46 and 48 are mounted between top longitudinal members 42 and 44 which are guide members allowing the lock doors 46 and 48 to slide along their longitudinal length thereby providing access to the inside of the display portion 16 so as to access the items I housed therein. Indeed, the lock doors 46 and 48 can also be provided with transparent sections so as to provide visual access to the inside of the display portion 16. Transparent material 22 such as glass is mounted between members top 42 and 44, and between top member 44 and median member 40.

The floor panel 36 and the longitudinal members 32 and 24 provide a space therebetween for an auxiliary drawer 50. The front panel 28 is mounted to the lateral panels and to the median member 38 and floor member 36 and includes a longitudinal notch 52 to provide a clearance for the drawer 50.

The back panel 30 is mounted to the panels 24 and 26, to the longitudinal member 40 and to the floor member 36. The foregoing provides a space 54 for receiving a storage enclosure 56 therein. As such, the storage portion 14 comprises the space 56 and the storage enclosure 56.

The storage enclosure 56 comprises a floor panel 58, front and rear panels 60 and 62 respectively and lateral frames 64 and 66. The support 20 is mounted onto a movement imparting device 68, positioned within the storage enclosure, for moving the support 20 between the item-displaying and item-storing positions. In this example, the movement imparting device 68 is a scissor jack powered by an actuator as a skilled will readily understand. The protective covers 18A and 18B include respective first panels 70A and 70B, respectively and second panels 72B and 72B, respectively. A pair of first and second panels 70A, 72A and 70B, 72B are respectively hinged together at a common pivotal edge 74A and 74B via respective hinges 76A and 76B. A pair of guides 77 are mounted on each frame 64 and 66 for guiding the protective covers 18A and 18B between the closed and open positions. Links such as pulley assemblies 78 are used to operationally link the support 20 to the protective covers 18A and 18B as will be further detailed herein.

Figure 4:
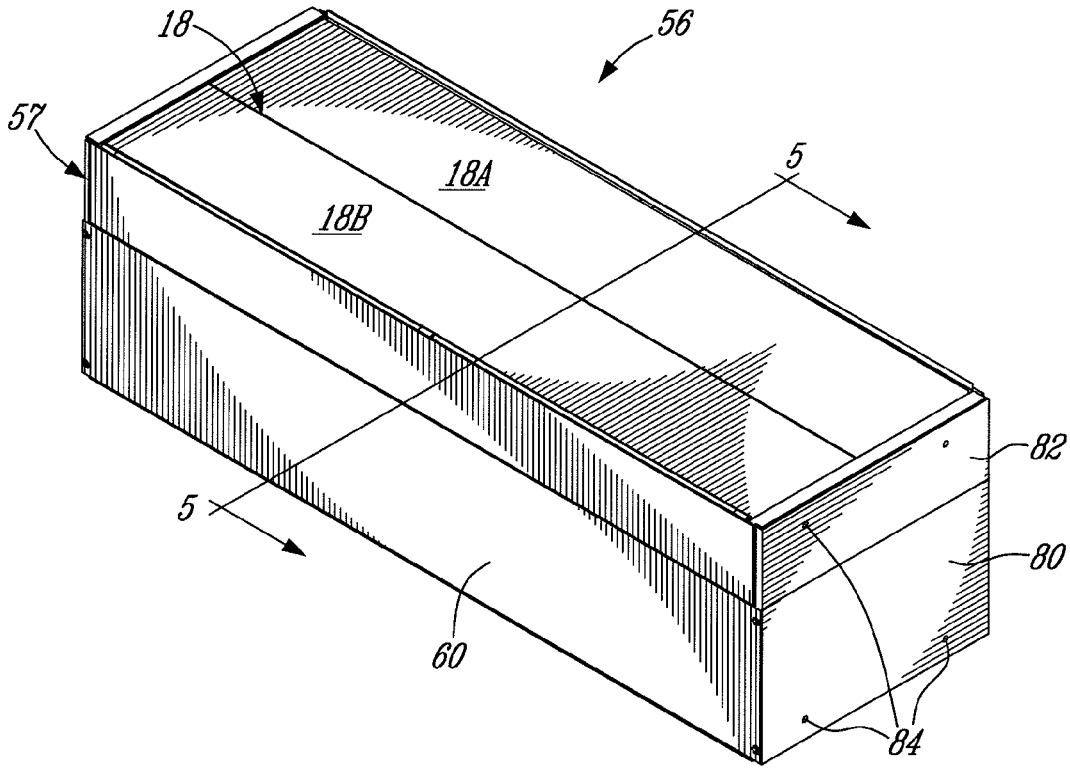
FIG. 4 is a perspective view of a storage enclosure for the security showcase of FIG. 1 in accordance with an illustrative embodiment of the present invention.

Turning now, to FIG. 4, the storage enclosure 56 is shown in an assembled and closed position thereby defining a main body 57. Lateral panels 80 and 82 are mounted to the frames 64 and 66 via fasteners 84. Top panels 86 are mounted above panels 60 and 62. In this way, the enclosure 56 is a closed rectangular box structure.

Figure 5:
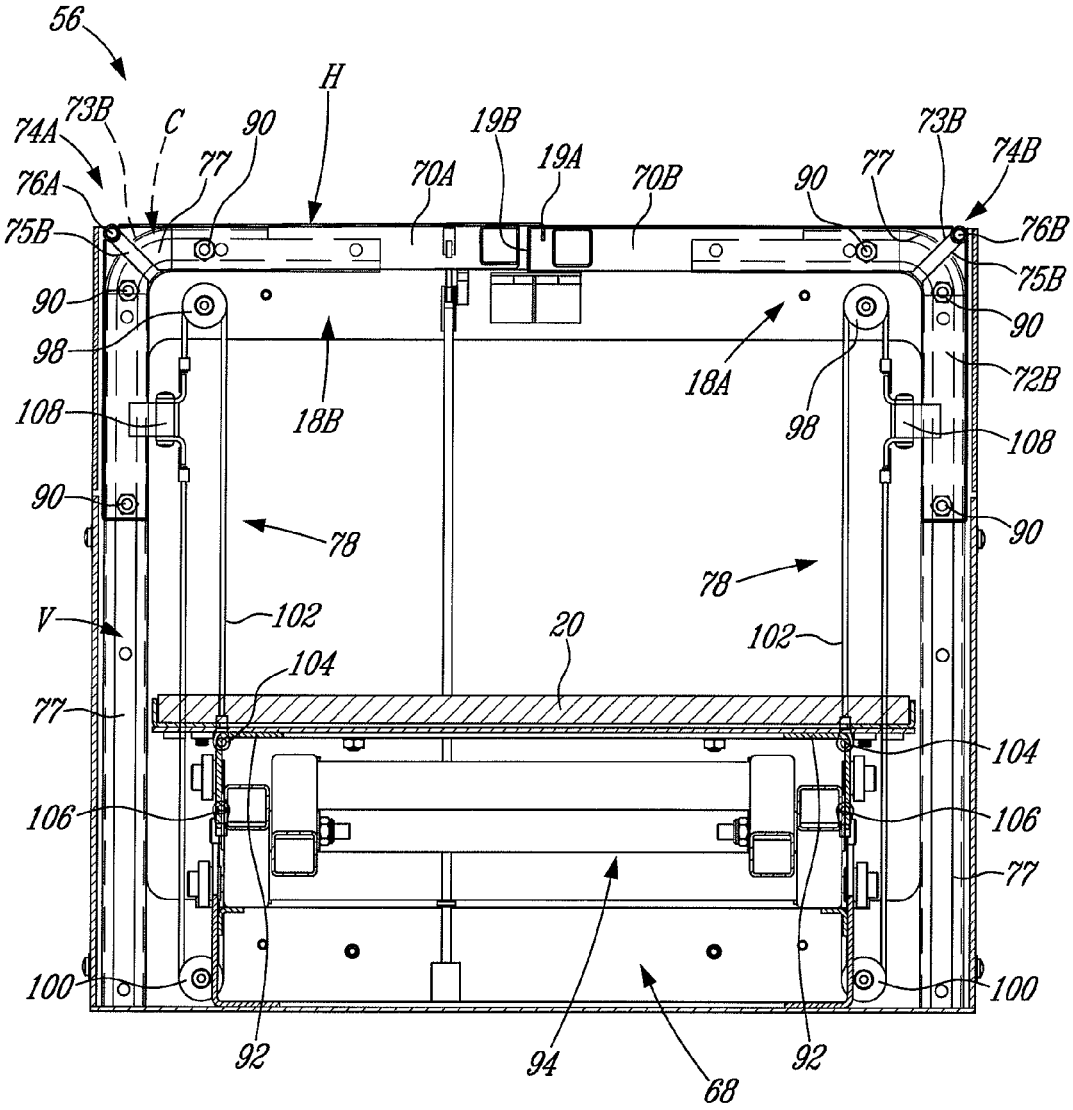
FIG. 5 is a lateral sectional view of the storage enclosure along the line 5-5 of FIG. 4 with the support thereof in the item-storing position and the closure elements thereof in the closed position.
Figure 6:
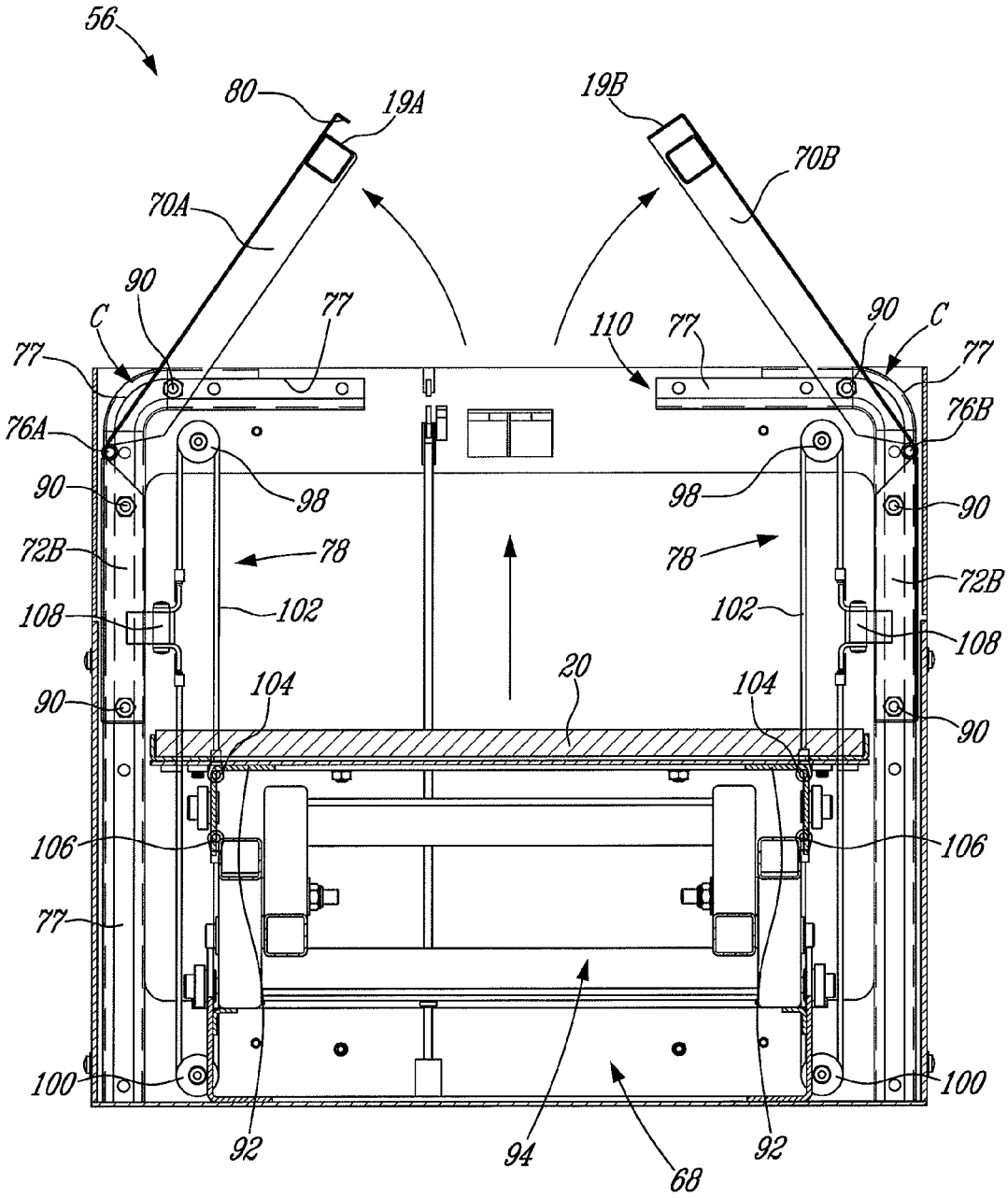
FIG. 6 is a lateral sectional view of the storage enclosure of FIG. 5 with the support thereof moving to the item-displaying position and the closure elements thereof moving to the open position.
Figure 7:
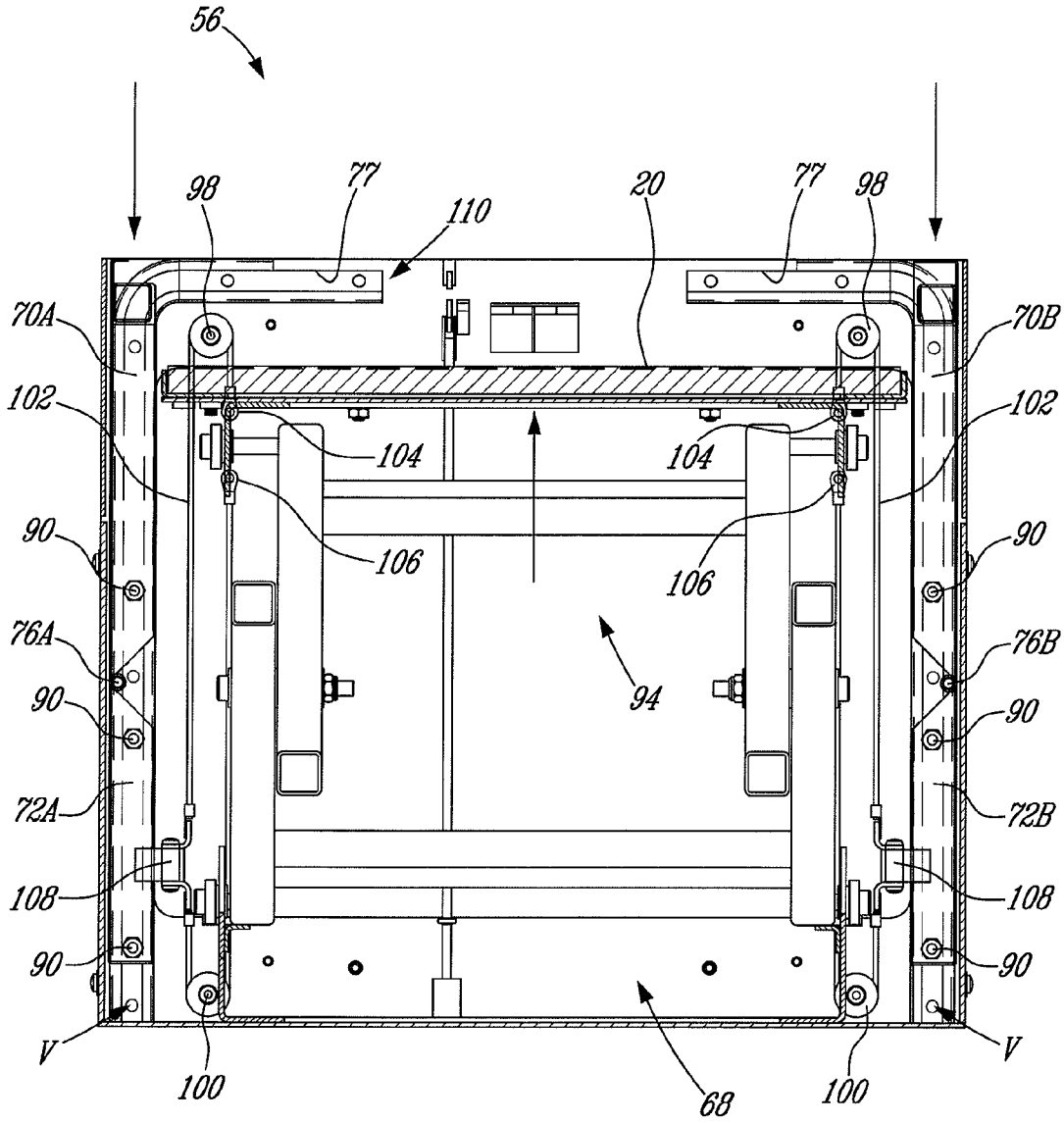
FIG. 7 is a lateral sectional view of the storage enclosure of FIG. 5 with the support thereof in the item-displaying position and the closure elements thereof in the open position.

With reference to FIGS. 5 to 7, the storage enclosure 56 of the security showcase 10, will be further described.

FIG. 5 shows the storage enclosure 56 in the item-storing position. Hence, the support 20 is in the item-storing position, having been lowered within the storage enclosure 56. Consequently, the protective covers 18A and 18B are in the closed position being mutually mated at their free ends 19A and 19B. Turning briefly to FIG. 6, the free ends 19A and 19B may include mutual engaging elements, such as a hook member 88 on the free end 19A of the protective cover 18A which is configured to engage a corresponding recess (not shown) near the free end 19B of protective cover 18B. When the protective covers 18A and 18B are in the closed position, their respective first panels 70A and 70B are in a generally horizontal position, along the horizontal portion H of their respective guides 77, while their respective second panels 72A and 72B are in a generally vertical position, along vertical portion V of their respective guides 77. The common edges 74A and 74B are positioned in the curved portion C of their respective guides 77. The common edge 74A is defined by the adjacent diagonally cut edges 73A and 75A of the first and second panels 70A and 72A respectively and are pivotally attached by hinge 76A. Likewise, the common edge 74B is defined by the adjacent diagonally cut edges 73B and 75B of the first and second panels 70B and 72B respectively and are pivotally attached by hinge 76B. The protective covers 18A and 18B include locating elements 90 that slidably engage the guides 77 during movement thereof as will be explained herein.

With reference to FIGS. 3 and 5, the support 20 is mounted on the top frame 92 of the scissor jack 68. The top frame 92 is lifted by the scissor or x-link actuator 94 mounted to the bottom frame 96 and powered by a hydraulic cylinder for example or other actuator. Scissor jacks 68 are well known in the art and need not be described any further.

The pulley assemblies 78 include top and bottom pulley wheels 98 and 100 pivotally mounted to their respective frames 64 and 66 and a conveyor in the form of a cable 102 slidably mounted thereto. The conveyor cable 102 is discontinuous so as to operationally link the movement of the platform 20 to the protective covers 18A and 18B. More specifically, each cable 102 is mounted to the top frame 92 via top and bottom links 104 and 106, respectively. The cables 102 are also mounted to the second panels 72A and 72B of the protective covers 18A and 18B, respectively, via a linkage 108.

Therefore, in operation when the movement imparting device 68 is actuated (by a variety of ways known in the art, for example a remote control button or by any other secure control device), the scissor links 94 causes the support 20 to raise as is shown in FIG. 6. As the support 20 moves upwardly, the conveying cables 102 act on the protective covers 18A and 18B via linkages 108, pulling the second panels 72A and 72B downwards along the guide 77, the first panels 70A and 70B are dragged along by panels 72A and 72B. More specifically, the panels 70A and 70B are pivoted upwardly as shown in FIG. 6, about their respective hinges 76A and 76B, this upward movement shown in FIG. 6 is provided by the configuration of the guides 77, namely the curved portion C thereof, as the locating elements 90 slide from the horizontal section H to the curved section C of the guides 77. This opening movement of the protective covers 18A and 18B, provides for exposing the opening 110 of the storage enclosure 56 (which is also the opening of the storage portion 14). The support 20 will be moved upwardly to a position provided by the movement imparting device 68 as shown in FIG. 7, wherein the support 20 can be at the opening 110, adjacent to the opening 110 or outwardly protruding from the opening 110 depending on the configuration of the support 20 and/or the movement imparting device 68. In this way, the first panels 70A and 70B are dragged downwardly by the second panels 72A and 72B respectively by the cables 102 acting thereon, positioning panels 70A and 70B in the vertical section V of the guides 77 within the storage enclosure 56. The opening 110 is fully exposed, thereby allowing the inside of the storage enclosure 56 to communicate with the display portion 16. The items I on the support 20 care therefore exposed and can be viewed through the display portion and the opening 110.

Hence, when the support 20 is moved from an item-storing position (FIG. 5) to the item-displaying position (FIG. 7), the closure 18 is moved from the closed position (FIG. 5), obscuring and protecting items I, to the open position (FIG. 7) exposing items I. Conversely, when the support 20 is moved downwardly towards the item-storing position (FIG. 5) from the item-displaying position (FIG. 7), the closure elements 18A and 18B are consequentially moved in the opposite direction (the reverse of FIG. 6), thereby moving the closure 18 from an open (FIG. 7) to a closed position (FIG. 5).

The protective covers 18A and 18B, therefore protect the contents within the storage portion 14. Furthermore, the fact that the protective covers 18A and 18B are operationally linked (in this example via pulley assemblies) to the movable support 20 make it even harder to open these protective covers 18A and 18B without activating the movement imparting device 68. Moreover, the movement imparting device 68 may include a locking mechanism which avoids actuation thereof without prior release of the locking mechanism. As illustrated the protective covers 18A and 18B do no have any external handles and are closely mated together or even include mutually engaging elements all of which substantially avoids them from being pried open by force.

The skilled artisan would also appreciate that a variety of auxiliary security measures can be taken, such as various sensors may be positioned on the protective covers 18A and 18B or the storage portion 14 or the display portion in order to send a signal to the alarm when there is involuntary intrusion.

Figure 8:
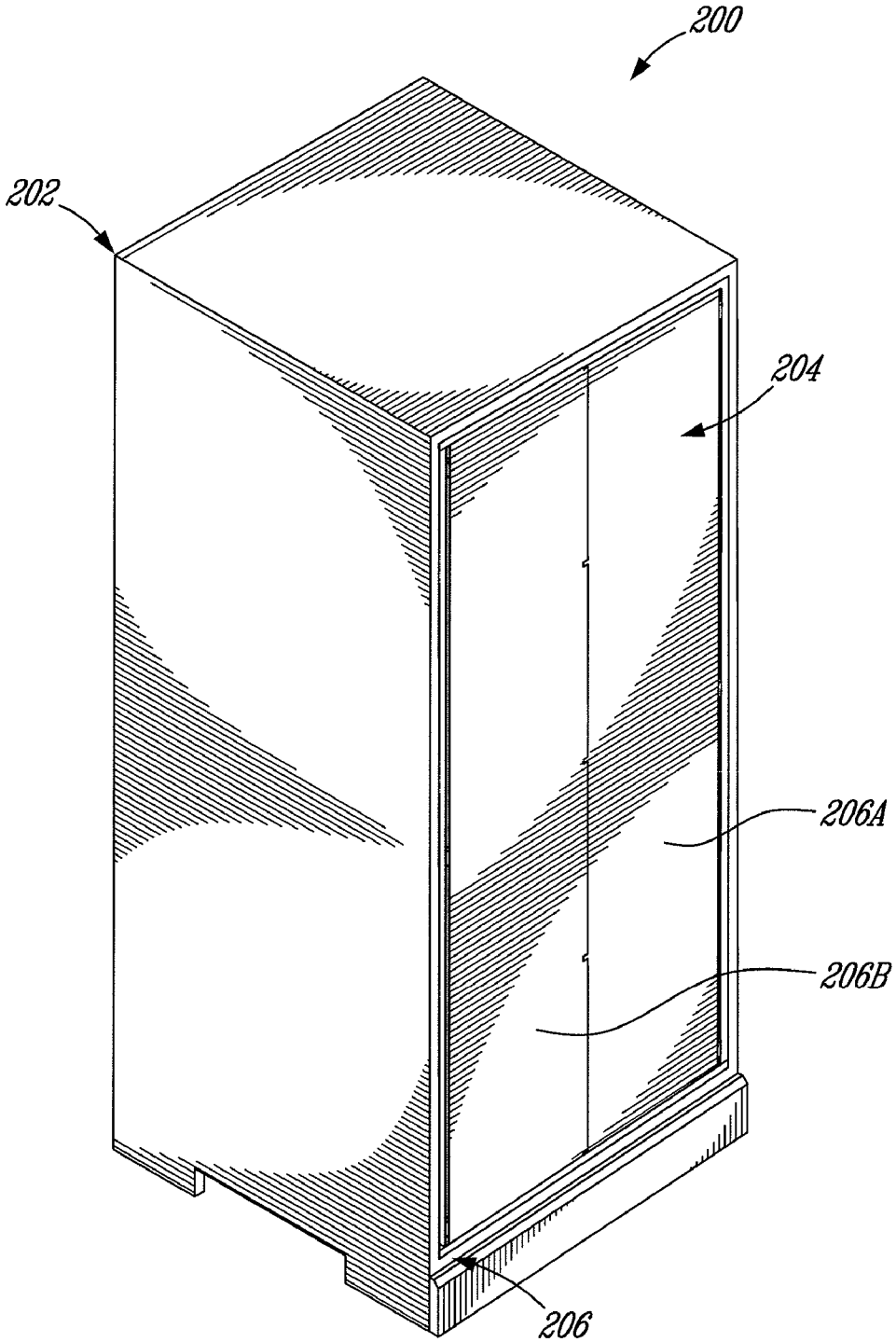
FIG. 8 is perspective view of a storage enclosure for a security showcase in an item-storing position in accordance with another illustrative embodiment of the present invention.
Figure 9:
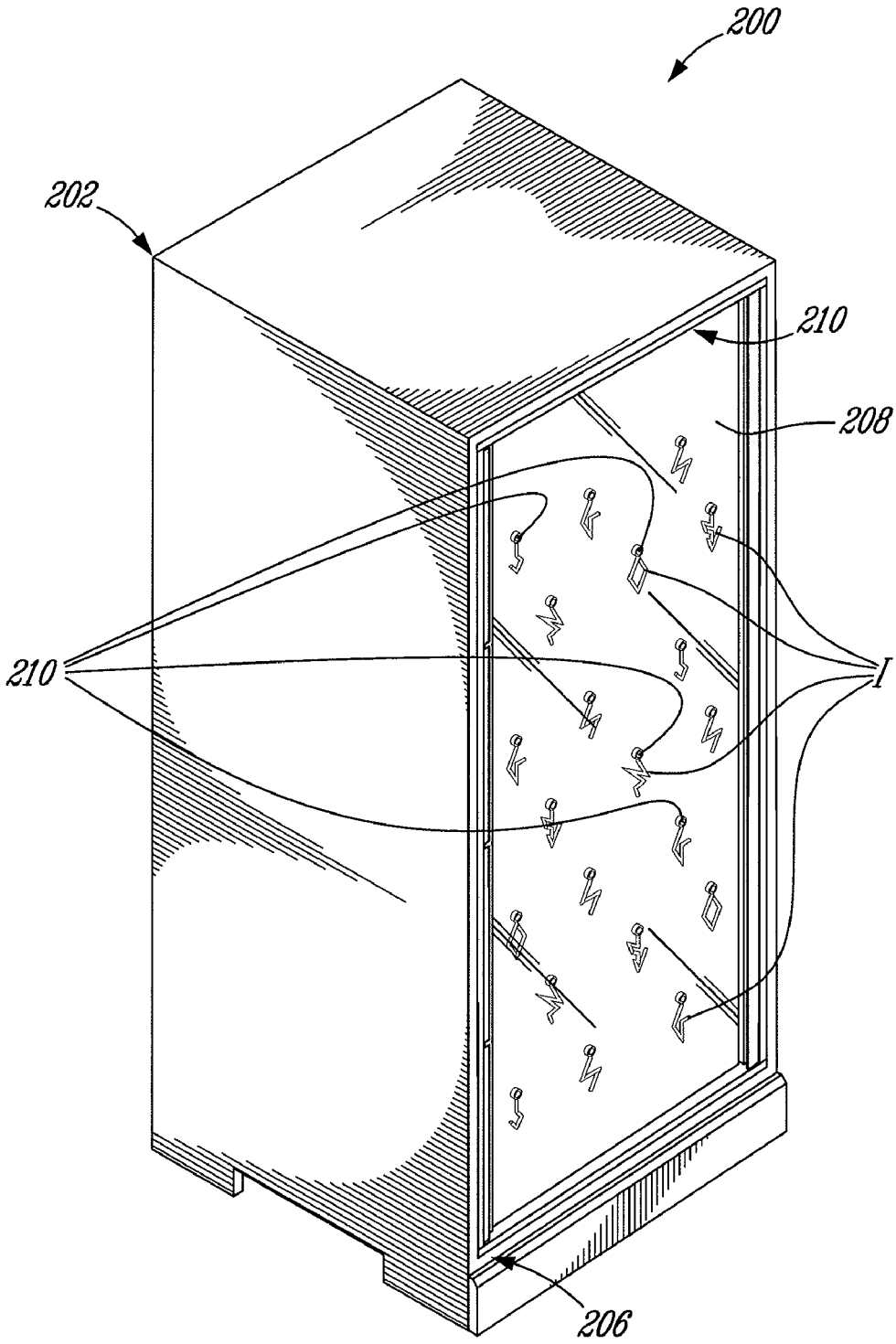
FIG. 9 is a perspective view of the storage enclosure of FIG. 8 in an item-displaying position.

With respect to FIGS. 8 to 9, a storage enclosure 200 for a generally vertical security showcase will now be described. In essence, storage enclosure 200 is similar to storage enclosure 56 with the main difference being that storage enclosure 200 is generally vertically configured as opposed to the generally horizontally configured storage enclosure 56. As such, the storage enclosure 200 defines the storage portion of a generally vertical security showcase. The skilled artisan will readily appreciate that such a generally vertical security showcase is similarly constructed to showcase 10, with the main difference being that showcase 10 be positioned in a generally vertical configuration.

The storage enclosure 200 includes a generally vertical longitudinal main body 202 having a closure 204 at a front face 206 thereof. The closure 206 includes a pair of closure elements 206A and 206B shown In the closed position in FIG. 8 and in the open position in FIG. 9. When the closure elements 206A and 206B are in the open position as in FIG. 9, the support 208 is in the item-displaying position at the opening 210. The support 208, is a generally vertical supporting structure and as such includes supporting elements 210, which can be hooks and the like, for supporting the items I.

Figure 10:
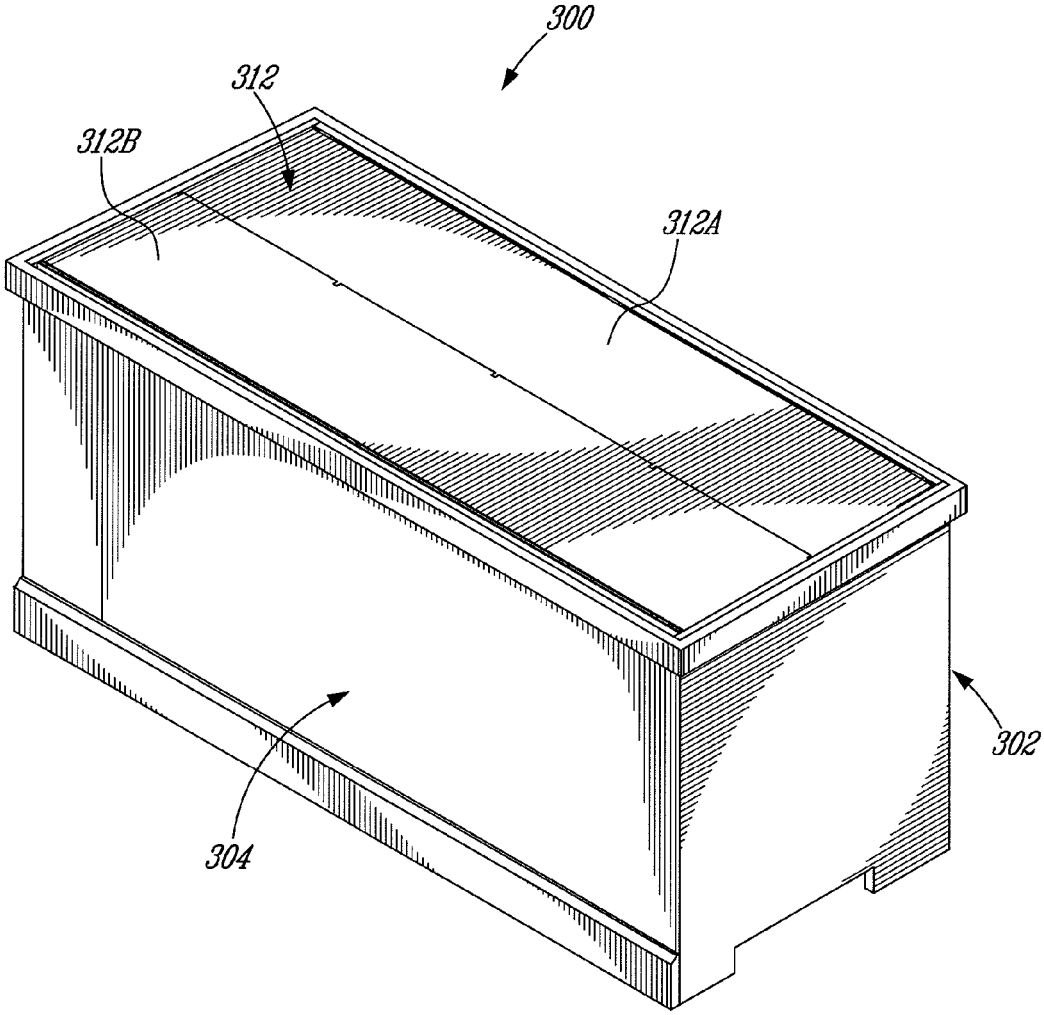
FIG. 10 is a perspective view of a security showcase in the item-storing position in accordance with another illustrative embodiment of the present invention.
Figure 11:
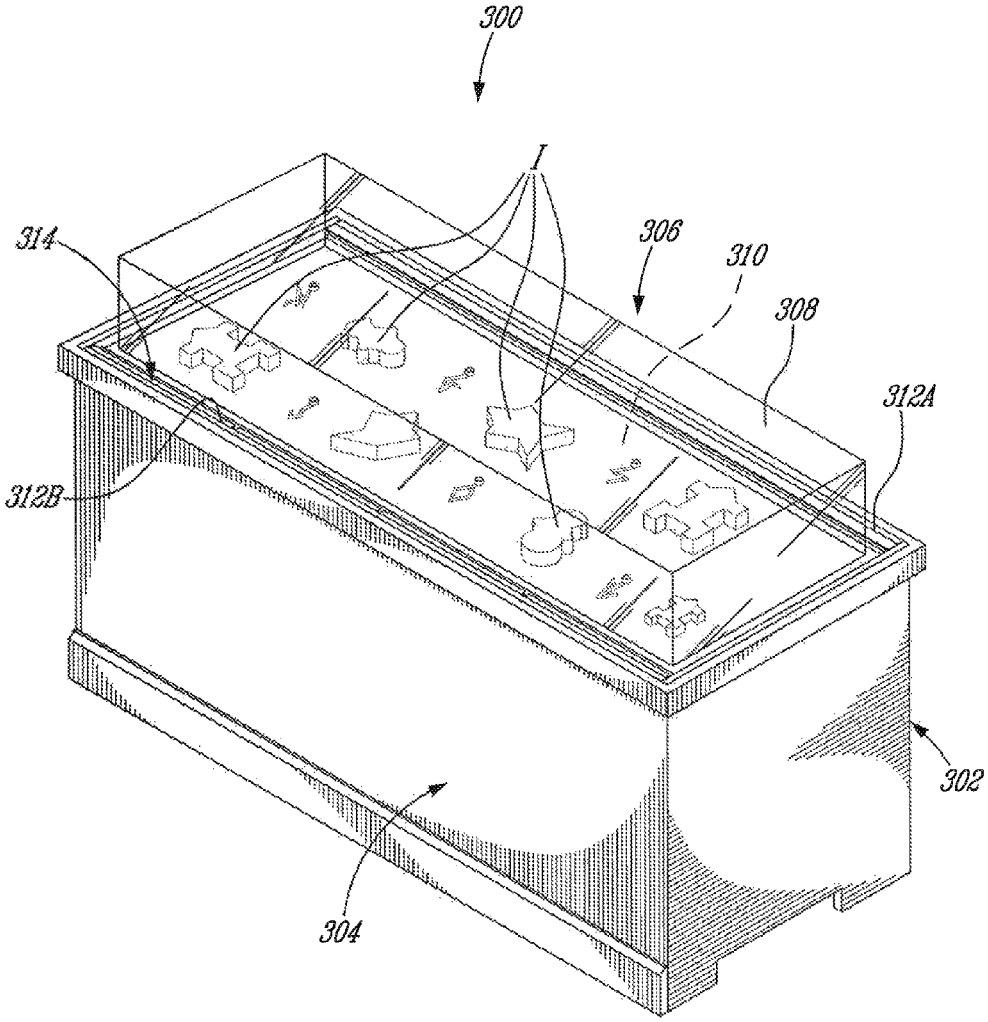
FIG. 11 is a perspective view of the security showcase of FIG. 10 in the item-displaying position.

With reference to FIGS. 10 and 11, a security showcase 300 in accordance with another embodiment of the present invention will now be described.

The security showcase 300 includes a housing 302 having a storage portion 304 and a display portion 306 (see FIG. 11). The display portion 306 includes an at least partially transparent housing 308 for housing items I on a support 310 such as a platform. The housing also includes a closure 312 movably mounted thereto and including closure elements 312A and 312B. As will be easily ascertained by the skilled artisan, security showcase 300 is similar to security showcase 10, with a main difference being that the display portion 306 is integral with the support 310. As such when the closure elements 312A and 312B move from a closed position (FIG. 10) to an open position (FIG. 11), thereby exposing the opening 314, and allowing the display portion 306 to move outwardly thereof, to expose the items I housed therein.

Figure 12:
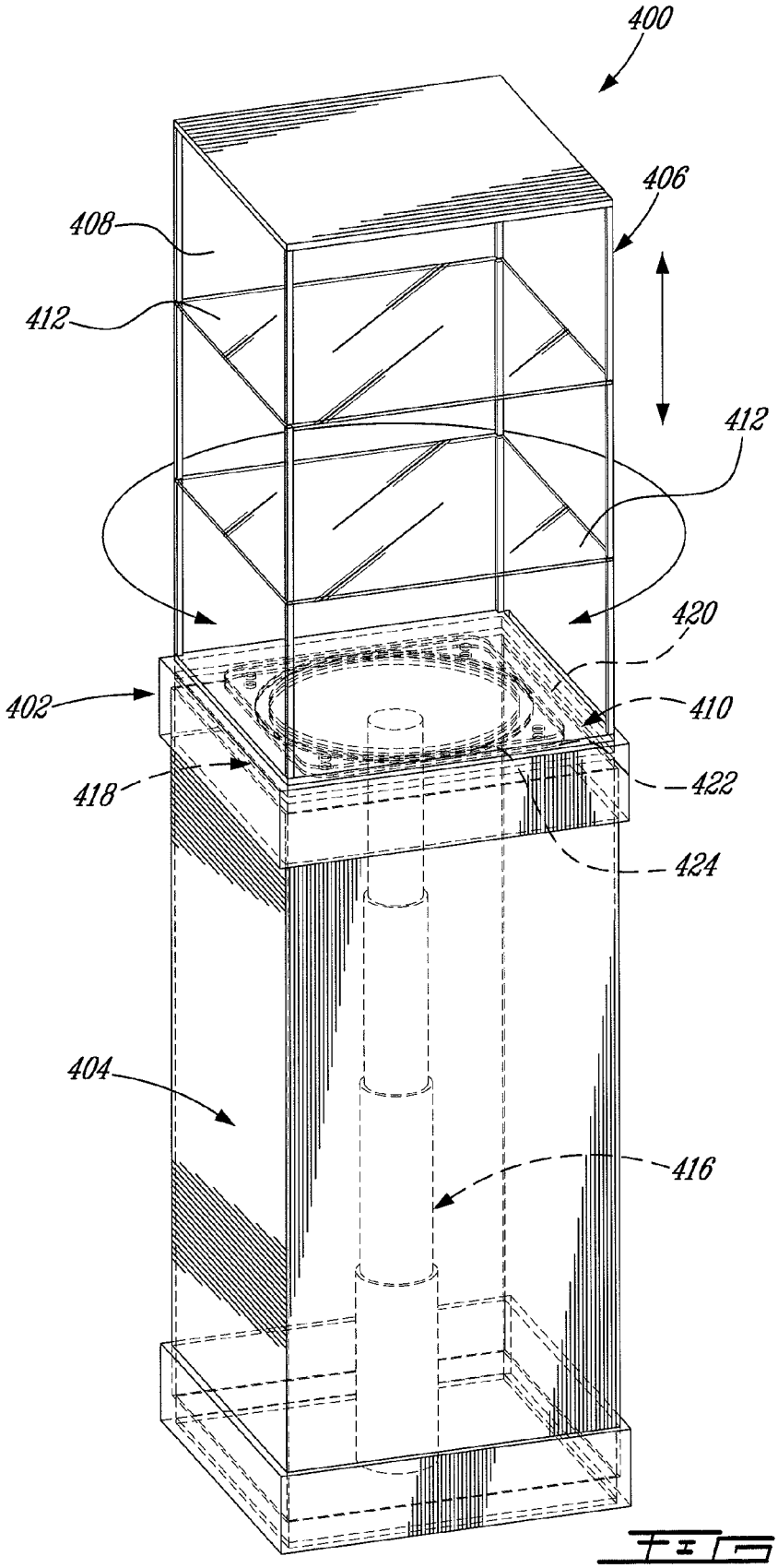
FIG. 12 is a perspective view of a security showcase in the item-displaying position in accordance with another illustrative embodiment of the present invention.

With reference to FIG. 12, a security showcase 400 in accordance with another illustrative embodiment of the present invention will now be described.

Security showcase 400 is a corner showcase (i.e. a showcase which can be positioned within a corner formed between two adjacent showcases which are positioned at an angle relative to one another). Security showcase 400 includes a generally rectangular housing 402 having a storage portion 404 and a display portion 406. The display portion 406 includes an at least partially transparent housing 408 having a base support 410 as well as auxiliary shelves 412 and 414. Support 410 and shelves 412 and 414 may carry items I thereon. A movement imparting device 416 is contained within the storage portion 404, in the form of a hydraulic telescoping cylinder. The hydraulic cylinder 416 is mounted to support 410 and is configured to vertically move the display portion 406 within the storage portion 404 during the item-storage position and out of the storage portion 404 via opening thereof 418 during the item-displaying position. The opening 418, may be selectively closed by a closure (not shown) such as a rigid panel, as is known in the art. Of course, closures as described above may also be provided.

The base support 410 includes a pair of panels 420 and 422, which are interconnected via circular row of bearings 424, providing a "lazy Suzanne" structure allowing the display portion 406 to be spun along its vertical axis.

Figure 13:
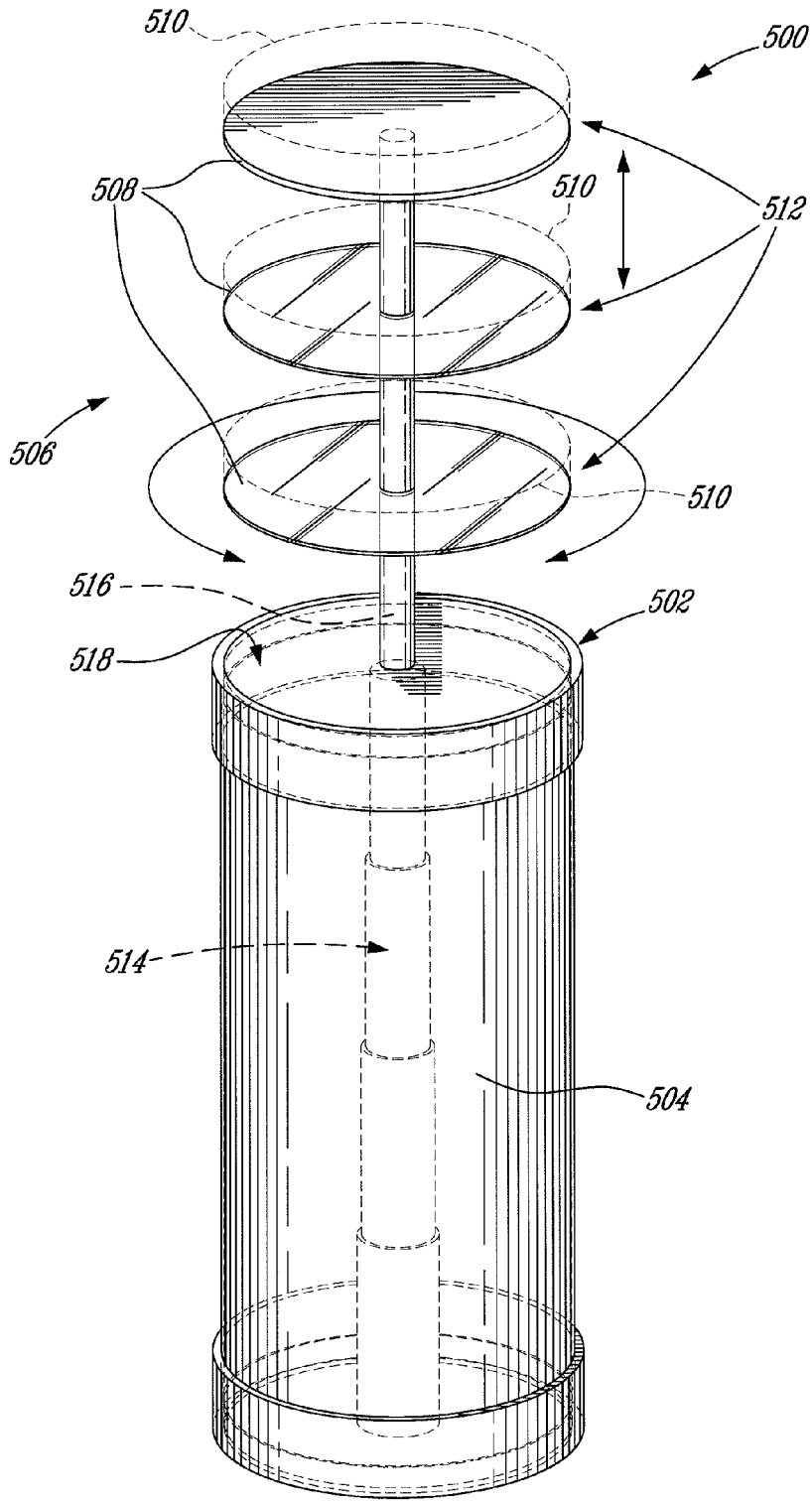
FIG. 13 is a perspective view of a security showcase in the item-displaying position in accordance with another illustrative embodiment of the present invention.

With reference to FIG. 13, a security showcase 500 in accordance with another illustrative embodiment of the present invention will now be described.

Security showcase 500 is similar to showcase 400 and includes a generally cylindrical housing 502 having a storage portion 504 and a display portion 506. The display portion 506 includes a plurality of supports 508 and at least partially transparent housings 510 forming display compartments 512 for housing items I therein. A movement imparting device 514 is contained within the storage portion 504, in the form of a hydraulic telescoping cylinder. The hydraulic cylinder 514 is mounted to a pole 516 which is mounted to each display compartment 512 and is configured to vertically move the display compartments 512 within the storage portion 504 during the item-storage position and out of the storage portion 504 via an opening 518 thereof during the item-displaying position. The opening 518, may be selectively closed by a closure (not shown) such as a rigid panel, as is known in the art. Of course, closures as described above may also be provided. The pole 516 is rotatable providing to rotate the display compartments 512 about its axis.

Figure 14:
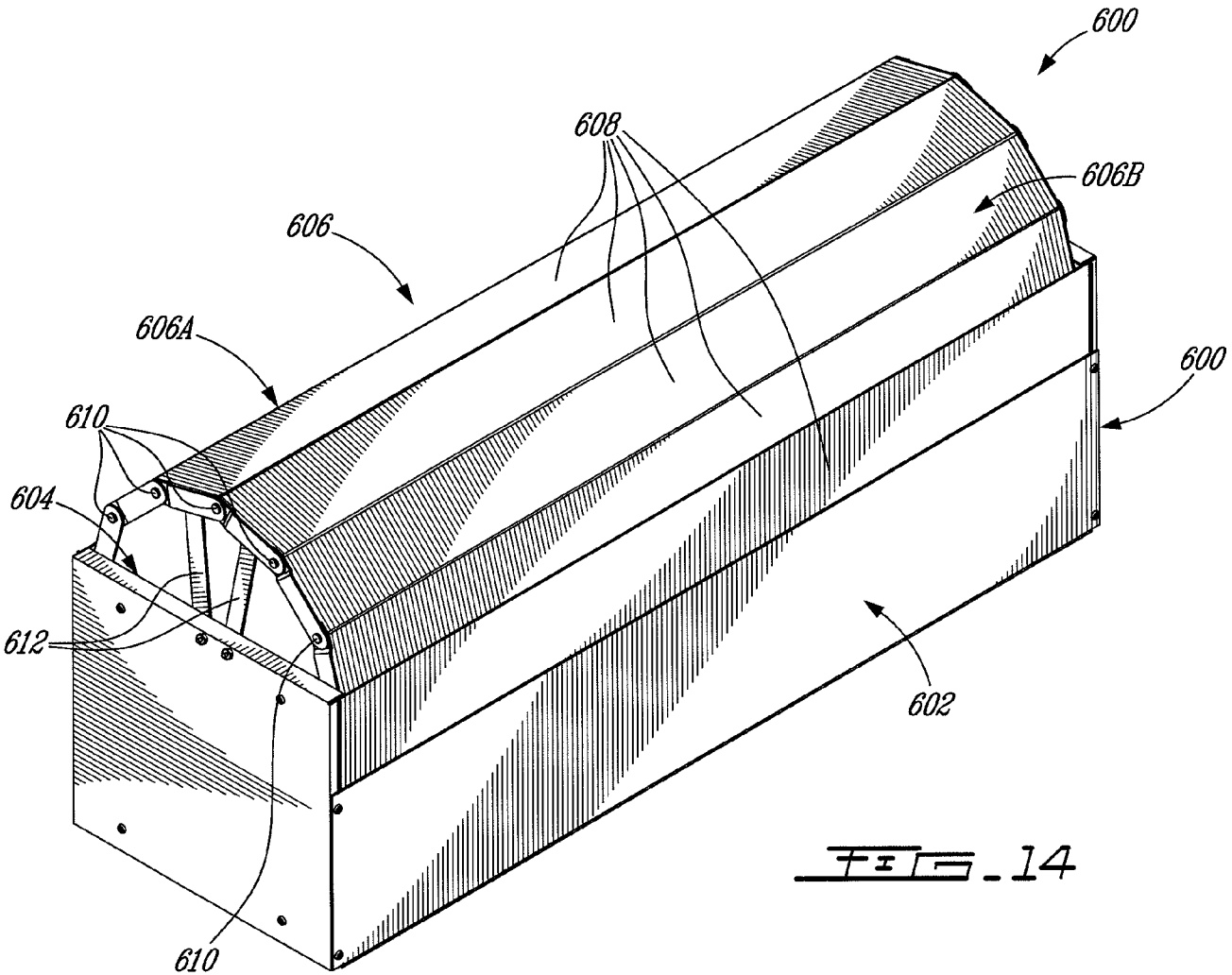
FIG. 14 is a perspective view of a security showcase in the item-storing position in accordance with another illustrative embodiment of the present invention.

Turning now to FIG. 14, a storage enclosure 600 for a security showcase in accordance with another illustrative embodiment of the present invention will now be described.

The storage enclosure 600 includes a main body, having a base 602 including a top opening 604. A closure 606 is mounted about the top opening 604 and having a dome like configuration. The closure 606 comprises a pair of closure elements 606A and 606B having respective convexly arcuate configurations. The closure elements 606A and 606B include a plurality of articulating cover panels 608 pivotally fastened together, via rivets 610, between two adjacent panels 608. The series of articulated panels 608 can lie flat against the walls of the base 602 when moving into the open or item-displaying position. The cover panels 608 disposed along the wall of the base 602 minimize the space used inside the storage enclosure 600. The openings next to the main levers 612 on both sides of the closure elements 606A and 606B of the illustrated embodiment allow to see the interior mechanism of the storage enclosure 600 but are normally closed to prevent any undesired access therein. As such, an at least partially transparent display portion (not shown) can be positioned on top of the to the storage enclosure. A support is mounted within the storage enclosure so as to support displayed items supported thereby. The main levers 612 can be actuated by a variety known movement imparting devices so as to move the closure elements 606A and 606B between open and closed positions.

Having now described various illustrated embodiments other embodiments and alternative features will now be described so as to further exemplify the present invention.

The security showcases of the invention may be provided in a variety of vertical, horizontal and diagonal configurations and sizes as well as various geometric shapes that would be esthetically appealing to consumers depending if these showcases are used in jewelry stores, art galleries or museums and the like. They may be made of various rigid and secure materials such as metal for example. High security showcases may also be accordingly armored. The security showcases of the invention may also be assemblies providing a plurality of storage and display portions.

The display portions of the invention may be provided in a variety of configurations and may be fully or partially transparent. In some instance, the display portions may include a single or a plurality of display compartments optionally having one or more shelves.

The storage portions may include internal storage enclosures in the form of box-like structures as described herein; the storage enclosures of the storage portions may also be integral to the housing of the showcases described herein. A storage portion may include more than one storage enclosure. The storage portions may also include transparent walls with their internal storage enclosures having obscuring walls. Conversely, the storage portions may include obscuring walls with their internal storage enclosures having transparent walls. It is again noted that the expression "storage portion" should be construed to comprise "storage enclosure". In one non-illustrated embodiment, the storage portion can be positioned above the display portion. In another non-illustrated embodiment, the storage portion may be positioned between two display portions and hence, this closures may be provided between the storage portion and each display portion.

The closures of the present invention may be provided in variety of suitable configurations. For example, they may include more than a pair of mutually mating closure elements or a single closure with portions thereof providing movement of such a closure within the context of the present invention. Hence, the skilled artisan would contemplate a closure having a articulating panels and being movable from a closed to an open position. The closures of the present invention need not be operationally linked to the supports described herein and as such may be automated by an independent movement imparting device.

The movement imparting devices for the supports and/or closures can comprise a variety of suitable actuators depending on the cost of a particular showcase, its size and configuration and other considerations. Of course other movement imparting devices such as manual levers, crankshafts and the like can also be contemplated within the scope of the invention.

The supports of the invention can include platforms, walls, a variety of trays, holders, and like elements. The supports may be fixed or movable by a variety of methods and devices. The supports may be generally vertical, generally horizontal or generally diagonal structures to give but a few possible examples.

Various links such as conveyors or electronic means can also be contemplated to operationally link the supports with the closures for simultaneous movement thereof.

In general, various artistic and stylistic considerations may be contemplated when designing such showcases within the context of the present invention depending on the intended use and consumer demands.

It should be noted that the various components and features of the non-limiting illustrative and non-illustrated embodiments of security showcases, storage enclosures and portions thereof or therefor described above can be combined in a variety of ways, as would be apparent to a person having ordinary skill in the art so as to provide other non-illustrated embodiments within the scope of the present invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. A security showcase comprising:

a housing comprising storage and display portions for respectively storing and displaying items;

said display portion comprising a support for supporting items thereon and an at least partially transparent housing structure extending from said support defining a space for enclosing the items therebetween, said support being positionable between an item-storing position, wherein said support is positioned within said storage portion, and an item-displaying position, wherein items supported by said support are displayed via said at least partially transparent housing structure; and a closure comprising at least a pair of closure elements moveably mounted to said housing and being movable between a closed position, wherein said closure elements are mutually mated thereby enclosing said support within said storage portion when in said item-storing position, and an open position when said support is in said item-displaying position.

2. A security showcase according to claim 1, wherein said support comprises a generally horizontal structure.

3. A security showcase according to claim 1, wherein said housing is a generally vertical structure.

4. A security showcase according to claim 1, wherein said display portion comprises a plurality of display compartments.

5. A security showcase according to claim 1, wherein said support comprises a platform.

6. A security showcase according to claim 1, wherein said support is movably mounted to said housing and movable between said item-storing position and said item-displaying position.

7. A security showcase according to claim 6, wherein said support is moved by a movement imparting device mounted within said storage portion, for moving said support between said item-storing position and said item-displaying position.

8. A security showcase according to claim 7, wherein said movement imparting device comprises an actuator.

9. A security showcase according to claim 6, wherein said closure elements are operationally linked to said movable support.

10. A security showcase according to claim 9, wherein said closure elements and said movable support are operationally linked via pulley assemblies, wherein the movement of said support to said item-storing position causes said closure elements to move to said closed position and the movement of said support to said item-displaying position cause said closure elements to move to said open position.

11. A security showcase according to claim 1, wherein said closure elements comprise oppositely disposed protective covers.

12. A security showcase according to claim 1, wherein said closure elements are moved by a movement imparting device.

13. A security showcase according to claim 1, wherein said closure elements are mounted to said storage portion, said storage portion comprising an opening thereof, said closure elements closing said opening when in said closed position and opening said storage portion opening when in said open position.

14. A security showcase according to claim 1, wherein said closure elements are moved within said storage portion when in said open position.

15. A security showcase according to claim 1, wherein said closure elements are mounted within said storage portion.

16. A security showcase according to claim 15, wherein said closure elements are movable along respective guides mounted within said storage portion so as to move between said open and closed positions.

17. A security showcase according to claim 16, wherein said closure elements comprise locating elements slideably mounted to said guide members.

18. A security showcase according to claim 1, wherein said closure elements comprise respective and pivotally connected first and second panels.

19. A security showcase according to claim 1, wherein said closure elements comprise respective generally arcuate configurations.

20. A security showcase according to claim 1, wherein said storage portion comprises a storage enclosure.

21. A security showcase according to claim 20, wherein said storage enclosure comprises an opening thereof, said closure elements closing said opening when in said closed position and opening said storage portion opening when in said open position.

22. A security showcase according to claim 20, wherein said closure elements are movably mounted to said storage enclosure.

23. A security showcase according to claim 22, wherein said closure elements are moved within said storage enclosure when in said open position.

24. A security showcase according to claim 20, wherein said support is mounted to said storage enclosure.

25. A security showcase according to claim 24, wherein said support is movably mounted to said storage enclosure and movable between said item-storing position and said item-displaying position.

26. A security showcase according to claim 25, wherein said support is moved by a movement imparting device mounted within said storage enclosure, for moving said support between said item-storing position and said item-displaying position.

27. A security showcase comprising:

a housing comprising storage and display portions for respectively storing and displaying items, said display portion comprising an at least partially transparent housing structure ;

a support integral to said display portion for supporting items thereon, said at least partially transparent housing structure extending from said support and defining a space for enlosing the items therebetween, said support being positionable between an item-storing position, wherein said support is positioned within said storage portion, and an item-displaying position, wherein items supported by said support are displayed in said display portion; and a closure moveably mounted to said housing and being movable between a closed position, for enclosing said support within said storage portion when in said item-storing position, and an open position, wherein said closure is positioned within said storage portion when said support is in said item displaying position.

28. A security showcase according to claim 27, wherein said closure comprises closure elements.

29. A security showcase according to claim 27, wherein said closure is mounted within said storage portion.

30. A security showcase according to claim 29, wherein said closure is movably mounted to guide members within said storage portion so as to be guided thereby between said open and closed positions.

31. A security showcase according to claim 27, wherein said support is movably mounted to said housing.

32. A security showcase according to claim 31, wherein said movable support is operationally linked to said closure for simultaneous movement thereof.

33. A security showcase comprising:

a storage portion for storing items therein and comprising an opening thereof;

a display portion for housing items to be displayed therein and being moveably mounted to said storage portion so as to be movable between an item-storing position, wherein said display portion is positioned within said storage portion, and an item-displaying position, wherein said display portion is positioned outwardly said opening thereby displaying the items, said display portion comprising a support for supporting the items thereon and an at least partially transparent housing structure extending from said support providing a space for enclosing the items therebetween; and a closure for selectively closing said opening thereby enclosing said display portion within said storage portion when in said item-storing position.

34. A security showcase according to claim 33, wherein said display portion is moved by a movement imparting device mounted within the storage portion.

35. A security showcase according to claim 33, wherein said closure comprises closure elements.

36. A security showcase according to claim 33, wherein said display portion and said closure are operationally linked for simultaneous movement thereof.

37. A storage enclosure for a security showcase comprising:

a main body for storing items therein and having an opening thereof;

a movement imparting device housed within said main body;

a support mounted within said main body on said movement imparting device for being lifted and descended thereby and adapted for supporting a plurality of separate and removable items thereon and being positionable between an item-storing position within said main body and an item-displaying position, wherein items supported by said support are to be displayed via said opening, and an at least partially transparent housing structure extending from said support for enclosing the items therebetween; and a pair of separate closure elements respectively comprising first and second hinged panels and being moveably mounted to said main body via guides and being movable between a closed position, wherein said closure elements closes said opening thereby enclosing said support within said main body when in said item-storing position, and an open position, wherein said closure elements are positioned within said storage enclosure when said support is in said item-displaying position; and a pulley assembly for operationally linking said support to said closure elements, wherein when said support is lifted said closure elements are moved to said open position and when said support is descended said closure elements are moved to said closed position.

38. A storage enclosure according to claim 37, wherein said guides comprise respective horizontal and vertical portions.

39. A storage enclosure according to claim 38, wherein said guides comprise a respective curved portion interposed between their respective said horizontal and vertical positions.

* * * * *